US009877372B2

(12) United States Patent
He et al.

(10) Patent No.: US 9,877,372 B2
(45) Date of Patent: Jan. 23, 2018

(54) DRIVING CIRCUIT AND DRIVING METHOD OF ORGANIC LIGHT EMITTING DIODE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Quanhua He, Beijing (CN); Lingyun Shi, Beijing (CN); Hao Zhang, Beijing (CN); Tiankuo Shi, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/524,243

(22) PCT Filed: Feb. 19, 2016

(86) PCT No.: PCT/CN2016/074149
§ 371 (c)(1),
(2) Date: May 3, 2017

(87) PCT Pub. No.: WO2017/041444
PCT Pub. Date: Mar. 16, 2017

(65) Prior Publication Data

US 2017/0332456 A1 Nov. 16, 2017

(30) Foreign Application Priority Data

Sep. 8, 2015 (CN) ..... 2015 1 0567944

(51) Int. Cl.
*H05B 33/08* (2006.01)
*G09G 3/32* (2016.01)

(52) U.S. Cl.
CPC ..... *H05B 33/0896* (2013.01)

(58) Field of Classification Search
None
See application file for complete search history.

(56) References Cited

U.S. PATENT DOCUMENTS 6,172,459 B1 1/2001 Hung et al.
2013/0099692 A1* 4/2013 Chaji ..... H05B 37/02 315/224
2014/0167626 A1 6/2014 Kim et al.

FOREIGN PATENT DOCUMENTS

CN 101025892 A 8/2007
CN 101826301 A 9/2010
(Continued)

OTHER PUBLICATIONS

International Search Report in Written Opinion in PCT/CN2016/074149 dated Jun. 2, 2016, with English translation. 16 pages.
(Continued)

*Primary Examiner* — Dedei K Hammond
(74) *Attorney, Agent, or Firm* — Blakely Sokoloff Taylor & Zafman LLP

(57) ABSTRACT

The present invention relates to a driving circuit of organic light emitting diode comprising an electricity storage unit having a positive polarity at a first terminal and a negative polarity at a second terminal, and a signal input unit having opposite polarities at the first and second terminals, the signal polarity of the signal input unit being changed according to a preset frequency; a control unit, which causes the first terminal of the signal input unit to transmit negative charges to the anode of the organic light emitting diode and causes the second terminal of the signal input unit to transmit positive charges to the cathode of the organic light emitting diode, when the signal polarity at the first terminal of the signal input unit is negative and the signal polarity of the second terminal thereof is positive, and causes the first terminal of the electricity storage unit to transmit positive charges to the anode of the organic light emitting diode and causes the second terminal of the electricity storage unit to transmit negative charges to the cathode of the organic light emitting diode, when the signal polarity at the first terminal of the signal input unit is positive and the signal polarity of the second terminal thereof is negative. The embodiments of the application can make the cathode of the organic light emitting diode accumulate electrons during the non-excitation period, so that when the electricity storage unit drives the organic light emitting diode to emit light, more electrons
(Continued)

can pass through the light emitting layer, so that the excitation subjected by the light emitting layer is improved and more light is emitted.

16 Claims, 3 Drawing Sheets

(56) References Cited

FOREIGN PATENT DOCUMENTS

| | | | |
|---|---|---|---|
| CN | 102411898 | A | 4/2012 |
| CN | 103021327 | A | 4/2013 |
| CN | 103366682 | A | 10/2013 |
| CN | 103413519 | A | 11/2013 |
| CN | 103531149 | A | 1/2014 |
| CN | 105185303 | A | 12/2015 |

OTHER PUBLICATIONS

Office Action in Chinese Application No. 201510567944.1 dated Mar. 31, 2017, with English translation. 11 pages.

* cited by examiner

DRIVING CIRCUIT AND DRIVING METHOD OF ORGANIC LIGHT EMITTING DIODE

TECHNICAL FIELD

The present application relates to the field of display technology, and more particularly to a driving circuit of organic light emitting diode, a driving method of organic light emitting diode, a display panel, and a display device.

BACKGROUND

At present, OLED (organic light-emitting diode) is one of the mainstream development directions of future display, but the luminous life and the use condition of the OLED itself limit the development speed and the use area of the OLED. The current focus is mainly on improvements of the OLED material and luminous efficiency.

SUMMARY

The technical problem to be solved by the present application is how to improve the luminous efficiency of the organic light emitting diode.

For this purpose, the present invention provides a driving circuit of organic light emitting diode comprising:

an electricity storage unit, the polarity of a first terminal of which is positive, and the polarity of a second terminal of which is negative;

a signal input unit, a first terminal and a second terminal of which input signals of opposite polarities to the driving circuit respectively, the signal polarities of the first and second terminals of the signal input unit being changed in accordance with a preset frequency;

a control unit, which causes the first terminal of the signal input unit to transmit negative charges to the anode of the organic light emitting diode and causes the second terminal of the signal input unit to transmit positive charges to the cathode of the organic light emitting diode, when the signal polarity at the first terminal of the signal input unit is negative and the signal polarity of the second terminal thereof is positive, and causes the first terminal of the electricity storage unit to transmit positive charges to the anode of the organic light emitting diode and causes the second terminal of the electricity storage unit to transmit negative charges to the cathode of the organic light emitting diode, when the signal polarity at the first terminal of the signal input unit is positive and the signal polarity of the second terminal thereof is negative.

Preferably, the control unit comprises:

a transistor, the gate of the transistor being connected to the first terminal of the signal input unit, the drain of the transistor being connected to the first terminal of the electricity storage unit, the source of the transistor being connected to the anode;

a switching unit for controlling the first terminal of the signal input unit to connect or disconnect with the anode, the first terminal of the signal input unit connecting with the anode when the signal polarity at the first terminal of the signal input unit is negative and the signal polarity at the second terminal is positive, the first terminal of the signal input unit disconnecting with the anode when the signal polarity at the first terminal of the signal input unit is positive and the signal polarity of the second terminal is negative.

Preferably, the switching unit comprises a diode, the positive pole of which is connected to the anode, and the negative pole of which is connected to the first terminal of the signal input unit.

Preferably the driving circuit further comprises:

an accelerating unit provided between the switching unit and the transistor for increasing the switching speed of the transistor.

Preferably, the acceleration unit comprises:

a resistor, a first terminal of the resistor being connected to the first terminal of the signal input unit, a second terminal of the resistor being connected to the gate of the transistor;

an accelerating capacitor, the first terminal of the accelerating capacitor being connected to the first terminal of the signal input unit and the second terminal of the accelerating capacitor being connected to the gate of the transistor.

Preferably, the electricity storage unit comprises a storage capacitor.

Preferably, the duration of the charging time of the storage capacitor is referred to as a first duration, the duration of the charging time thereof is referred to as a second duration, a state in which the polarity of the first terminal of the signal input unit is negative and the polarity of the second terminal thereof is positive lasts for a third duration, and a state in which the polarity of the first terminal of the signal input unit is positive and the polarity of the second terminal thereof is negative lasts for a fourth duration, and the first duration is equal to the third duration, and the second duration is equal to the fourth duration.

The present application also provides a display panel comprising the above-mentioned driving circuit of organic light emitting diode.

The present application also provides a display device comprising the above-described display panel.

The present application also provides a driving method of organic light emitting diode based on the above driving circuit of organic light emitting diode, comprising:

when the signal polarity at the first terminal of the signal input unit is negative and the signal polarity of the second terminal thereof is positive, the first terminal of the signal input unit is caused to transmit negative charges to the anode of the organic light emitting diode, and the second terminal of the signal input unit is caused to transmit positive charges to the cathode of the organic light emitting diode, when the signal polarity at the first terminal of the signal input unit is positive and the signal polarity of the second terminal thereof is negative, the first terminal of the electricity storage unit is caused to transmit positive charges to the anode, and the second terminal of the electricity storage unit is caused to transmit negative charges to the cathode.

With the above-described technical solution, the cathode of the organic light emitting diode can be accumulated with electrons when the signal polarity at the first terminal of the signal input unit is negative and the signal polarity at the second terminal of the signal input unit is positive, so that more electrons can be rendered to pass through the light-emitting layer, making the light-emitting layer receive more excitation and generate more light.

BRIEF DESCRIPTION OF DRAWINGS

The features and advantages of the invention will be more clearly understood by reference to the accompanying drawings, which are schematic and not to be construed as limiting the invention. And it should be appreciated that the drawings are not drawn to scale, and that some parts may be exaggerated to highlight the innovations of the present application. In the drawings.

DESCRIPTION OF REFERENCE SIGNS

1—electricity storage unit; 2—signal input unit; 3—control unit; 31—transistor; 32—switching unit; 4—accelerating unit; 41—resistor; 42—accelerating capacitor; 11—anode; 12—cathode; 13—electron injection layer; 14—hole injection layer; 15—light emitting layer.

DETAILED EMBODIMENTS

The present invention will now be described in further detail with reference to the accompanying drawings and specific embodiments in order to provide a clearer understanding of the above objects, features and advantages of the present invention. It is to be noted that the embodiments of the present application and the features in the embodiments may be combined with each other without conflict.

Many specific details are set forth in the following description so as to facilitate fully understanding of the invention, but the invention may be embodied in other ways different from those described herein, and thus the protection scope of the invention is not limited to the following detailed embodiments disclosed hereafter.

Figure 1:
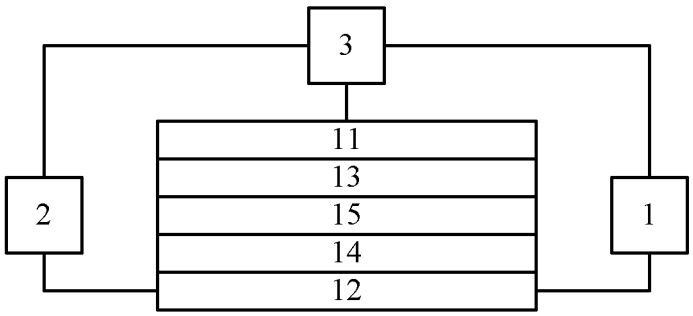
FIG. 1 shows a schematic structural view of a driving circuit of organic light emitting diode according to an embodiment of the present invention.

As shown in FIG. 1, a driving circuit of organic light emitting diode according to an embodiment of the present invention comprises an electricity storage unit 1, a signal input unit 2, and a control unit 3.

The polarity of the first terminal of the electricity storage unit 1 is positive and the polarity of the second terminal is negative.

The first and second terminals of the signal input unit 2 respectively input signals of opposite polarities from the outside to the driving circuit, and the polarities of the signals at the first terminal and the second terminal change at a preset frequency. For example, the first and second terminals of the signal input unit 2 may be connected to a timing circuit, and the timing circuit may transmit signals of opposite polarities to the first and second terminals, respectively. Alternatively, the first and second terminals of the signal input unit 2 may also be connected to an alternating voltage source, and the alternating voltage source transmits signals of opposite polarities to the first and second terminals, respectively.

The control unit 3 causes the first terminal of the signal input unit 2 to transmit negative charges to the anode 11 of the organic light emitting diode and causes the second terminal of the signal input unit 2 to transmit positive charges to the cathode 12 of the organic light emitting diode, when the signal polarity at the first terminal of the signal input unit 2 is negative and the signal polarity of the second terminal thereof is positive; and causes the first terminal of the electricity storage unit 1 to transmit positive charges to the anode 11 of the organic light emitting diode and causes the second terminal of the electricity storage unit 1 to transmit negative charges to the cathode 12 of the organic light emitting diode, when the signal polarity at the first terminal of the signal input unit 2 is positive and the signal polarity of the second terminal thereof is negative.

When the signal polarity at the first terminal of the signal input unit 2 is negative and the signal polarity of the second terminal is positive (hereinafter referred to as the first time period), since the first terminal of the signal input unit 2 transmits negative charges to the anode 11 of the organic light emitting diode and the second terminal transmits positive charges to the cathode 12 of the organic light emitting diode, the direction of the electric field in the organic light emitting diode is from the cathode 12 to the anode 11, so that more electrons in the hole injecting layer 14 of the organic light emitting diode accumulate at the cathode 12, and more holes in the electron injecting layer 13 of the organic light emitting diode accumulate at the anode 11.

When the signal polarity at the first terminal of the signal input unit 2 is positive and the signal polarity of the second terminal is negative (hereinafter referred to as a second time period), since the first terminal of the electricity storage unit 1 transmits positive charges to the anode 11, and the second terminal of the electricity storage unit 1 transmits negative charges to the cathode 12, the direction of the electric field in the organic light emitting diode is from the anode 11 to the cathode 12, so that the electrons accumulated at the cathode 12 move through the light emitting layer 15 toward the anode 11.

It is to be understood that the drawings schematically show only the structure of main layers of the organic light emitting diode, and the description of the components such as the insulating layer and the substrate in the organic light emitting diode is omitted, and the dimensions such as the thicknesses of the layers are not drawn to scale.

In the prior art, only the second time period exists for driving the organic light emitting diode to emit light, and there is not the first time period. Comparably, this embodiment causes the cathode 12 to be accumulated with more electrons in the first time period so that in the second time period more electrons pass through the light emitting layer 15, and the excitation subjected by the light emitting layer 15 is increased, and more light is emitted, and the luminous efficiency is improved.

Figure 2:
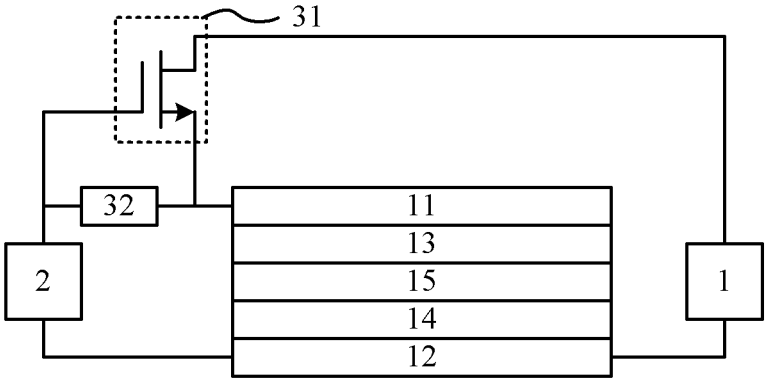
FIG. 2 shows a schematic structural view of a driving circuit of organic light emitting diode according to still another embodiment of the present invention.

As shown in FIG. 2, it is preferable that the control unit 3 comprises a transistor 31 and a switching unit 32.

The gate of the transistor 31 is connected to the first terminal of the signal input unit 2, the drain is connected to the first terminal of the electricity storage unit 1, and the source is connected to the anode 11.

The switching unit 32 is used for connecting and disconnecting the first terminal of the control signal input unit 2 with the anode 11, and specifically for connecting when the polarity of the first terminal of the signal input unit 2 is negative and the polarity of the second terminal is positive, and for disconnecting when the polarity of the first terminal of the signal input unit 2 is positive and the polarity of the second terminal is negative.

The transistor 31 and the switching unit 32 can easily control the way of the signal input unit 2 and the electricity storage unit 1 providing electric charges to the organic light emitting diode.

In the first time period, the signal output from the first terminal of the signal input unit 3 to the gate of the transistor 31 is negative and the transistor 31 is turned off. Since the switching unit 32 is turned on, the first terminal of the signal input unit 2 can provide negative charges to the anode 11 of the organic light emitting diode so that the electron injection layer 13 accumulates holes in the vicinity of the anode 11. At the same time, the second terminal of the signal input unit 3 provides positive charges to the cathode 12 of the organic light emitting diode, so that the hole injecting layer 14 accumulates electrons in the vicinity of the cathode 12.

In the second time period, the signal output from the first terminal of the signal input unit 3 to the gate of the transistor 31 is positive, and the transistor 31 is turned on, and the source and the drain thereof are turned on. And due to the switching unit 32 is turned off, the first terminal of the unit 3 is not connected with the anode 11 of the organic light emitting diode, so that the first terminal of the electricity storage unit 1 can supply positive charges to the anode 11 of the organic light emitting diode while the second terminal of the electricity storage unit 1 provides negative charges to the cathode 12 of the organic light emitting diode. Therefore, the direction of the electric field in the organic light emitting diode is from the anode 11 to the cathode 12, so that electrons accumulated near the cathode 12 move through the light emitting layer 15 toward the anode 11 to excite the light emitting layer 15 to emit light.

Figure 3:
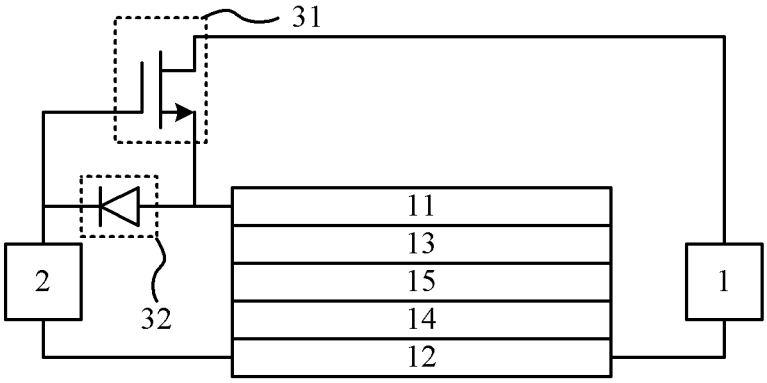
FIG. 3 shows a schematic structural view of a driving circuit of organic light emitting diode according to still another embodiment of the present invention.

As shown in FIG. 3, it is preferable that the switching unit 32 comprises a diode, and the positive electrode of the diode is connected to the anode 11, and the negative electrode is connected to the first terminal of the signal input unit 2.

In the first time period, the negative electrode of the diode receives the low voltage, the diode is turned on, and the first terminal of the signal input unit 2 can supply negative charges to the anode 11 of the organic light emitting diode through the diode; in the second time period, the negative electrode of the diode receives high voltage, and the diode is turned off, so that the first terminal of the signal input unit 2 can not be connected with the anode 11 of the organic light emitting diode.

Figure 4:
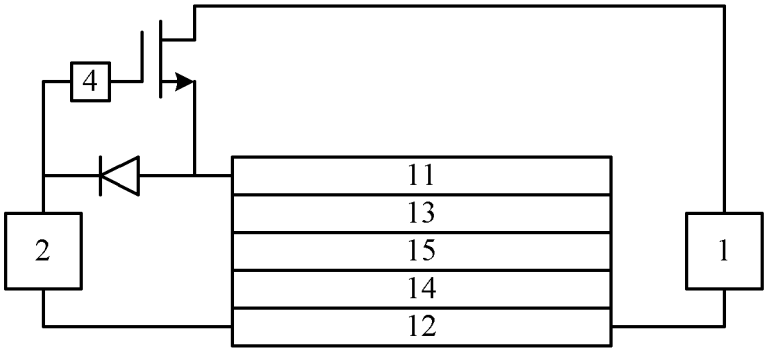
FIG. 4 shows a schematic structural view of a driving circuit of organic light emitting diode according to still another embodiment of the present invention.

As shown in FIG. 4, it is preferable that the driving circuit further comprises an accelerating unit 4 which is provided between the switching unit 32 and the transistor 33 for increasing the switching speed of the transistor 33.

Since the signal input at both terminals of the signal input unit 2 is constantly changed, the transistor is frequently turned on and off. And due to the junction capacitance within the transistor, delay exists in the turning on and off of the transistor, resulting in the electricity storage unit can not promptly drive the organic light-emitting diode to generate light.

By means of the acceleration unit, it can be ensured that the transistor is quickly turned on and off, to ensure that the electricity storage unit in the second time period quickly drives the organic light-emitting diode to generate light.

Figure 5:
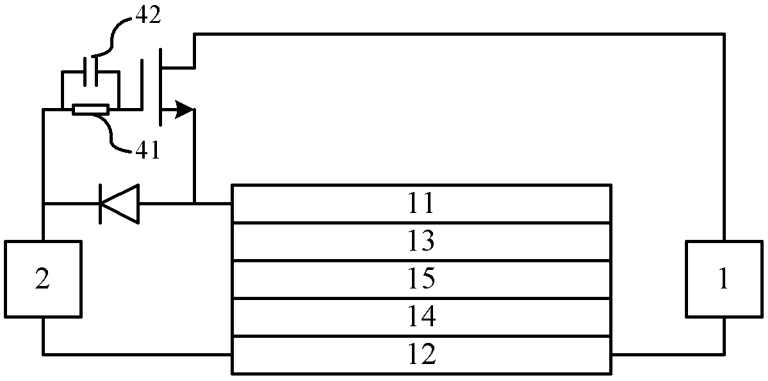
FIG. 5 shows a schematic structural view of a driving circuit of organic light emitting diode according to still another embodiment of the present invention.

As shown in FIG. 5, it is preferable that the accelerating unit 4 comprises a resistor 41 and an accelerating capacitor 42.

The first terminal of the resistor 41 is connected to the first terminal of the signal input unit 2 and the second terminal thereof is connected to the gate of the transistor 31. The first terminal of the accelerating capacitor 42 is connected to the first terminal of the signal input unit 2 and the second terminal thereof is connected to the gate of the transistor 31.

In the first time period, the first terminal of the signal input unit 2 has a high level. Since the voltage across the accelerating capacitor 42 can not be abruptly changed, the high level is totally applied to the gate of the transistor 31 so that the transistor 31 is turned on rapidly. During the accelerating capacitor is gradually charged to be saturated, the signal voltage applied to the gate of the transistor 31 gradually decreases and tends to be stable, and the transistor 31 enters a stable conducting state.

In the second time period, the first terminal of the signal input unit 2 has a low level. Since the accelerating capacitor 42 is filled with electric charges in the first time period, the polarity of the first terminal of the accelerating capacitor 42 is positive, the polarity of the second terminal is negative, and the voltage across the accelerating capacitor 42 can not be abruptly changed, so that the second terminal of the accelerating capacitor 42 connected to the gate of the transistor 31 will extract the positive charge from the gate of the transistor 31 more quickly, so that the transistor 31 get into the off state more quickly. This ensures that the transistor 31 is quickly turned on and off.

Figure 6:
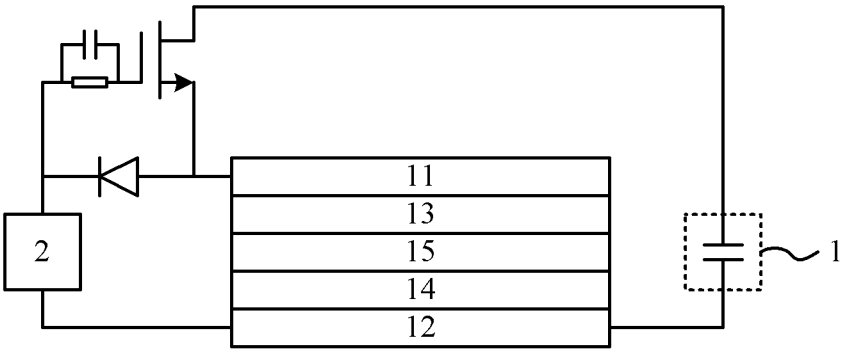
FIG. 6 shows a schematic structural view of a driving circuit of organic light emitting diode according to still another embodiment of the present invention.

As shown in FIG. 6, it is preferable that the electricity storage unit 1 comprises a storage capacitor.

It is preferable that, the duration of continuously charging of the storage capacitor is referred to as a first duration, the duration of continuously discharging thereof is referred to as a second duration, the state in which the polarity of the first terminal of the signal input unit 2 is negative and the polarity of the second terminal is positive lasts for a third duration, and the state in which the first terminal of the signal input unit 2 is positive and the polarity of the second terminal is negative lasts for a fourth duration. Wherein, the first duration is equal to the third duration, the second duration is equal to the fourth duration.

After the storage capacitor is fully charged, it is needed to drive the organic light emitting diode to generate light, so that the first duration can be set to equal to the third duration. That is, during the charging of the storage capacitor, the polarity of the first terminal of the signal input unit 2 is negative and the polarity of the second terminal is positive, so that the holes are accumulated in the vicinity of the anode 11 of the organic light emitting diode, and electrons are accumulated in the vicinity of the cathode 12. It is ensured that the light emitting layer 15 can be more effectively excited when the storage capacitor discharges electricity to the organic light emitting diode. And setting the second duration to be equal to the fourth duration is possible to ensure that the first terminal of the signal input unit 2 can stably provide a high voltage to the gate of the transistor 31 during the discharging of the storage capacitor to the organic light emitting diode, and the transistor 31 is turned on. Thereby it is ensured that the storage capacitor continually discharges electricity to the organic light emitting diode.

The present application also provides a display panel comprising the above-mentioned driving circuit of organic light emitting diode. The present application also provides a display device comprising the above-described display panel.

It should be noted that the display device in the present embodiments may be any product or component having a display function, such as an electronic paper, a mobile phone, a tablet computer, a television set, a notebook computer, a digital photo frame, a navigator, or the like.

Figure 7:
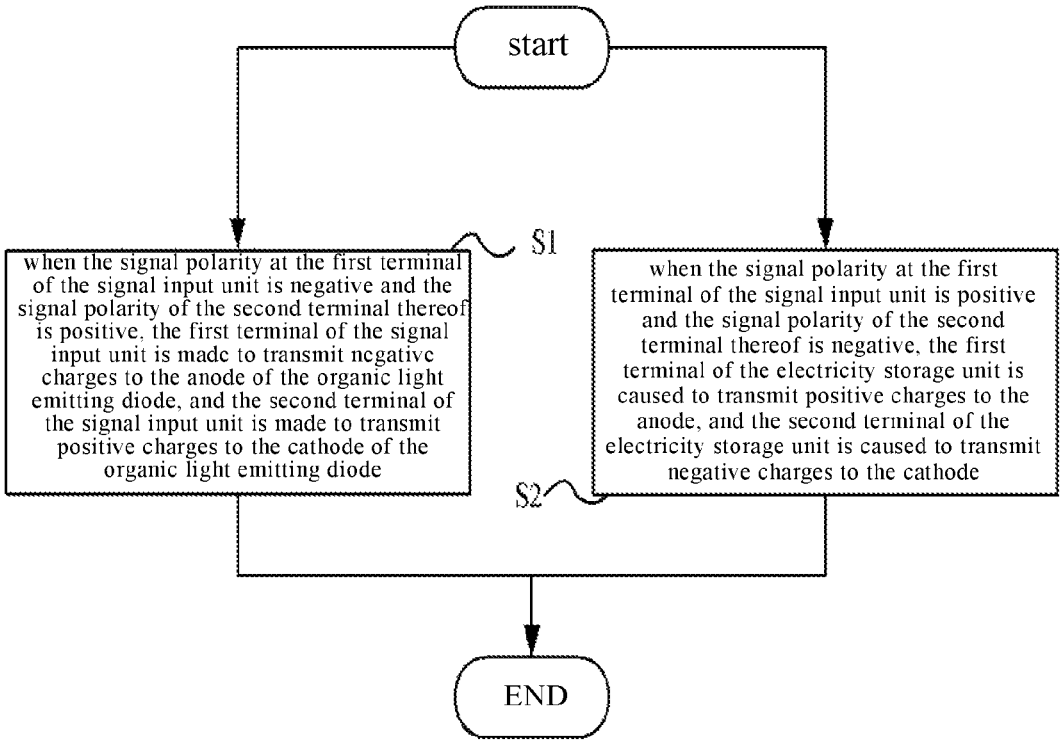
FIG. 7 shows a schematic flow diagram of a driving method of organic light emitting diode according to one embodiment of the present invention.

As shown in FIG. 7, the present application also provides a driving method of organic light emitting diode based on the driving circuit of organic light emitting diode described above, comprising:

at S1, when the signal polarity at the first terminal of the signal input unit is negative and the signal polarity of the second terminal thereof is positive, the first terminal of the signal input unit is caused to transmit negative charges to the anode of the organic light emitting diode, and the second terminal of the signal input unit is caused to transmit positive charges to the cathode of the organic light emitting diode;

at S2, when the signal polarity at the first terminal of the signal input unit is positive and the signal polarity of the second terminal thereof is negative, the first terminal of the electricity storage unit is caused to transmit positive charges to the anode, and the second terminal of the electricity storage unit is caused to transmit negative charges to the cathode.

The technical solution of the present application has been described in detail with reference to the accompanying drawings, which improves the luminous efficiency of the organic light emitting diode compared to the prior art. According to the technical solution of the present application, electrons can be accumulated at the cathode of the organic light emitting diode when the signal polarity at the first terminal of the signal input unit is negative and the signal polarity of the second terminal is positive, so that while the electricity storage unit drives the organic light emitting diode, it is possible to make more electrons pass through the light-emitting layer so that the excitation of the light-emitting layer is improved and more light is emitted.

In the present application, the terms "first", "second", "third", and "fourth" are for descriptive purposes only and are not to be construed as indicating or imposing relative importance.

The foregoing is merely illustrative of the preferred embodiments of the present invention and does not intend to limit the present invention, and various changes and modifications may be made by those skilled in the art. Any modifications, equivalent substitutions, improvements, and the like within the spirit and principles of the invention are intended to be included within the protection scope of the present invention. It should be noted that the wording "comprising" does not exclude the presence of elements or steps not listed in the claims. The word 'a' or 'an' in front of an element does not exclude the presence of multiple such elements. The mere fact that certain measures are recited in mutually different dependent claims does not indicate that the combination of these measures can not be used to advantage. Any reference signs in the claims should not be construed as limiting the scope.

The invention claimed is:

1. A driving circuit of an organic light emitting diode comprising:

an electricity storage unit, the polarity of a first terminal of which is positive, and the polarity of a second terminal of which is negative;

a signal input unit, a first terminal and a second terminal of which input signals of opposite polarities to the driving circuit respectively, the signal polarities of the first and second terminals of the signal input unit being changed in accordance with a preset frequency;

a control unit, which causes the first terminal of the signal input unit to transmit negative charges to the anode of the organic light emitting diode and causes the second terminal of the signal input unit to transmit positive charges to the cathode of the organic light emitting diode, when the signal polarity at the first terminal of the signal input unit is negative and the signal polarity at the second terminal thereof is positive, and causes the first terminal of the electricity storage unit to transmit positive charges to the anode of the organic light emitting diode and causes the second terminal of the electricity storage unit to transmit negative charges to the cathode of the organic light emitting diode, when the signal polarity at the first terminal of the signal input unit is positive and the signal polarity of the second terminal thereof is negative.

2. The driving circuit of the organic light emitting diode according to claim 1, wherein the control unit comprises:

a transistor, the gate of the transistor being connected to the first terminal of the signal input unit, the drain of the transistor being connected to the first terminal of the electricity storage unit, the source of the transistor being connected to the anode; and a switching unit for controlling the first terminal of the signal input unit to connect or disconnect with the anode, the first terminal of the signal input unit connecting with the anode when the signal polarity at the first terminal of the signal input unit is negative and the signal polarity at the second terminal is positive, the first terminal of the signal input unit disconnecting with the anode when the signal polarity at the first terminal of the signal input unit is positive and the signal polarity of the second terminal is negative.

3. The driving circuit of the organic light emitting diode according to claim 2, wherein the switching unit comprises a diode, the positive pole of which is connected to the anode and the negative pole of which is connected to the first terminal of the signal input unit.

4. A driving method of the driving circuit of the organic light emitting diode according to claim 3, comprising:

when the signal polarity at the first terminal of the signal input unit is negative and the signal polarity of the second terminal thereof is positive, the first terminal of the signal input unit is caused to transmit negative charges to the anode of the organic light emitting diode, and the second terminal of the signal input unit is caused to transmit positive charges to the cathode of the organic light emitting diode, when the signal polarity at the first terminal of the signal input unit is positive and the signal polarity of the second terminal thereof is negative, the first terminal of the electricity storage unit is caused to transmit positive charges to the anode, and the second terminal of the electricity storage unit is caused to transmit negative charges to the cathode.

5. The driving circuit of the organic light emitting diode according to claim 2, further comprising:

an accelerating unit provided between the switching unit and the transistor for increasing the switching speed of the transistor.

6. The driving circuit of the organic light emitting diode according to claim 5, wherein the acceleration unit comprises:

a resistor, a first terminal of the resistor being connected to the first terminal of the signal input unit, a second terminal of the resistor being connected to the gate of the transistor; and an accelerating capacitor, the first terminal of the accelerating capacitor being connected to the first terminal of the signal input unit and the second terminal of the accelerating capacitor being connected to the gate of the transistor.

7. A driving method of the driving circuit of the organic light emitting diode according to claim 6, comprising:

when the signal polarity at the first terminal of the signal input unit is negative and the signal polarity of the second terminal thereof is positive, the first terminal of the signal input unit is caused to transmit negative charges to the anode of the organic light emitting diode, and the second terminal of the signal input unit is caused to transmit positive charges to the cathode of the organic light emitting diode, when the signal polarity at the first terminal of the signal input unit is positive and the signal polarity of the second terminal thereof is negative, the first terminal of the electricity storage unit is caused to transmit positive charges to the anode, and the second terminal of the electricity storage unit is caused to transmit negative charges to the cathode.

8. A driving method of the driving circuit of the organic light emitting diode according to claim 5, comprising:

when the signal polarity at the first terminal of the signal input unit is negative and the signal polarity of the second terminal thereof is positive, the first terminal of the signal input unit is caused to transmit negative charges to the anode of the organic light emitting diode, and the second terminal of the signal input unit is caused to transmit positive charges to the cathode of the organic light emitting diode, when the signal polarity at the first terminal of the signal input unit is positive and the signal polarity of the second terminal thereof is negative, the first terminal of the electricity storage unit is caused to transmit positive charges to the anode, and the second terminal of the electricity storage unit is caused to transmit negative charges to the cathode.

9. A driving method of the driving circuit of the organic light emitting diode according to claim 2, comprising:

when the signal polarity at the first terminal of the signal input unit is negative and the signal polarity of the second terminal thereof is positive, the first terminal of the signal input unit is caused to transmit negative charges to the anode of the organic light emitting diode, and the second terminal of the signal input unit is caused to transmit positive charges to the cathode of the organic light emitting diode, when the signal polarity at the first terminal of the signal input unit is positive and the signal polarity of the second terminal thereof is negative, the first terminal of the electricity storage unit is caused to transmit positive charges to the anode, and the second terminal of the electricity storage unit is caused to transmit negative charges to the cathode.

10. The driving circuit of the organic light emitting diode according to claim 1, wherein the electricity storage unit comprises a storage capacitor.

11. The driving circuit of the organic light emitting diode according to claim 10, wherein the duration of the charging time of the storage capacitor is referred to as a first duration, the duration of the charging time thereof is referred to as a second duration, a state in which the polarity of the first terminal of the signal input unit is negative and the polarity of the second terminal thereof is positive lasts for a third duration, and a state in which the polarity of the first terminal of the signal input unit is positive and the polarity of the second terminal thereof is negative lasts for a fourth duration, and the first duration is equal to the third duration, and the second duration is equal to the fourth duration.

12. A driving method of the driving circuit of the organic light emitting diode according to claim 11, comprising:

when the signal polarity at the first terminal of the signal input unit is negative and the signal polarity of the second terminal thereof is positive, the first terminal of the signal input unit is caused to transmit negative charges to the anode of the organic light emitting diode, and the second terminal of the signal input unit is caused to transmit positive charges to the cathode of the organic light emitting diode, when the signal polarity at the first terminal of the signal input unit is positive and the signal polarity of the second terminal thereof is negative, the first terminal of the electricity storage unit is caused to transmit positive charges to the anode, and the second terminal of the electricity storage unit is caused to transmit negative charges to the cathode.

13. A driving method of the driving circuit of the organic light emitting diode according to claim 10, comprising:

when the signal polarity at the first terminal of the signal input unit is negative and the signal polarity of the second terminal thereof is positive, the first terminal of the signal input unit is caused to transmit negative charges to the anode of the organic light emitting diode, and the second terminal of the signal input unit is caused to transmit positive charges to the cathode of the organic light emitting diode, when the signal polarity at the first terminal of the signal input unit is positive and the signal polarity of the second terminal thereof is negative, the first terminal of the electricity storage unit is caused to transmit positive charges to the anode, and the second terminal of the electricity storage unit is caused to transmit negative charges to the cathode.

14. A display panel comprising the driving circuit of the organic light emitting diode according to claim 1.

15. A display device comprising the display panel according to claim 14.

16. A driving method of the driving circuit of the organic light emitting diode according to claim 1, comprising:

when the signal polarity at the first terminal of the signal input unit is negative and the signal polarity of the second terminal thereof is positive, the first terminal of the signal input unit is caused to transmit negative charges to the anode of the organic light emitting diode, and the second terminal of the signal input unit is caused to transmit positive charges to the cathode of the organic light emitting diode, when the signal polarity at the first terminal of the signal input unit is positive and the signal polarity of the second terminal thereof is negative, the first terminal of the electricity storage unit is caused to transmit positive charges to the anode, and the second terminal of the electricity storage unit is caused to transmit negative charges to the cathode.

* * * * *